US009234320B2

(12) United States Patent
Abresch et al.

(10) Patent No.: US 9,234,320 B2
(45) Date of Patent: Jan. 12, 2016

(54) ROAD MILLING MACHINE, AS WELL AS METHOD FOR MOUNTING A CANTILEVERED MILLING DRUM

(71) Applicant: Wirtgen GmbH, Windhagen (DE)

(72) Inventors: Stefan Abresch, Dierdorf (DE); Dirk Brassel, Windhagen (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/268,530

(22) Filed: May 2, 2014

(65) Prior Publication Data

US 2014/0333118 A1 Nov. 13, 2014

(30) Foreign Application Priority Data

May 10, 2013 (DE) ..... 10 2013 208 638

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *Y10T 29/49817* (2015.01); *Y10T 29/49947* (2015.01); *Y10T 29/49948* (2015.01)

(58) Field of Classification Search
CPC ..... E01C 23/088; E01C 23/127
See application file for complete search history.

(56) References Cited

U.S. PATENT DOCUMENTS

| | | | | | |
|---|---|---|---|---|---|
| 4,225,191 | A | * | 9/1980 | Knoski | 301/35.627 |
| 4,704,045 | A | * | 11/1987 | Taylor et al. | 404/90 |
| 4,878,713 | A | | 11/1989 | Zanetis | |
| 5,505,598 | A | * | 4/1996 | Murray | 404/90 |
| 6,106,073 | A | * | 8/2000 | Simons et al. | 299/39.6 |
| 6,877,818 | B1 | | 4/2005 | Gaertner et al. | |

(Continued)

FOREIGN PATENT DOCUMENTS

| | | | |
|---|---|---|---|
| DE | 10232489 | A1 | 1/2004 |
| DE | 10347873 | A1 | 5/2005 |

(Continued)

OTHER PUBLICATIONS

European Search Report in European Patent Application EP 14166448, dated Sep. 9, 2014, 3 pp.

*Primary Examiner* — John Kreck
(74) *Attorney, Agent, or Firm* — Lucian Wayne Beavers; Patterson Intellectual Property Law, PC

(57) ABSTRACT

In a road milling machine, in particular small milling machine, for working road surfaces, with a machine frame, with a milling drum supported in the machine frame and capable of being driven by a milling drum drive, where stud bolts for mounting the milling drum project from the milling drum drive, said stud bolts, in mounted condition, engaging with cut-outs arranged accordingly in a connecting flange of the milling drum, it is provided for the following features to be achieved: that the milling drum drive comprises, as a minimum, one mounting stud which engages with a corresponding opening adapted to said mounting stud in the connecting flange of the milling drum, wherein the mounting stud projects axially vis-à-vis the stud bolts to such an extent that the milling drum rests on the mounting stud prior to engaging with the stud bolts.

20 Claims, 5 Drawing Sheets

(56) References Cited

U.S. PATENT DOCUMENTS

| | | | | |
|---|---|---|---|---|
| 6,997,641 | B2 | 2/2006 | Gaertner et al. | |
| 7,901,011 | B2 * | 3/2011 | Holl et al. | 299/39.4 |

FOREIGN PATENT DOCUMENTS

| | | | |
|---|---|---|---|
| EP | 1194651 | A1 | 4/2002 |
| WO | 0104422 | A1 | 1/2001 |

* cited by examiner

ROAD MILLING MACHINE, AS WELL AS METHOD FOR MOUNTING A CANTILEVERED MILLING DRUM

BACKGROUND OF THE INVENTION

1. Field of the Invention

The invention relates to a road milling machine, in particular small milling machine, for working road surfaces, as well as to a method for mounting a cantilevered milling drum.

2. Description of the Prior Art

A quick-change system for milling drums is known from EP 1 194 651 A in which the milling drum is divided and comprises a basic drum body and a milling tube suitable for pushing onto the basic drum body. As only the milling tube needs to be replaced, handling for the replacement of a milling drum is facilitated so that the time and amount of work required for the replacement are minimized. However, said quick-change system essentially relates to large milling machines with a milling drum diameter of approx. 1 m and a milling width ranging between 1.50 m and 4.40 m.

In small milling machines, on the other hand, the milling drum is of an integral design. The length of a milling drum for a small milling machine is typically smaller than its diameter. For example, milling drums for small milling machines have a diameter ranging from 460 mm to 750 mm at a width of between 250 mm and 600 mm.

A further difference between the milling drums of a small milling machine and a large milling machine is that, on the outer circumference of milling drums for small milling machines, toolholders are welded directly onto the drum whereas, with milling drums for large milling machines, quick-change toolholders are used in which a basic part is welded onto the drum which accommodates a toolholder in a replaceable fashion.

Such a small milling machine is known, for example, under the designation Wirtgen W 50 DC. The basic design of a generic road milling machine is known from DE 103 47 873 A1.

The small milling machine comprises a milling drum that is supported at the machine frame in a drum casing and can be driven by a milling drum drive.

The known milling drum drive comprises a drum gearbox which, at its free end, comprises a connecting flange with axially projecting stud bolts for mounting the milling drum. The stud bolts engage with a connecting flange of the milling drum in drill holes arranged accordingly so that the milling drum can be fastened at the drum gearbox by means of nuts. Furthermore, the drum gearbox may comprise a centering spigot which interacts with a corresponding central opening in the connecting flange of the cantilevered milling drum.

The milling drums used for small milling machines usually have a high weight of, for example, up to 300 kg. They are therefore too heavy to allow manual mounting. Handling an integrally designed milling drum for small milling machines is additionally made more difficult due to the fact that the connecting flange is not arranged in the centre of the milling drum axially as approx. two thirds of the interior space of the milling drum is taken up by the milling drum drive. In view of this, the connecting flange of a milling drum for small milling machines is usually located in the vicinity of the front end of the milling drum opposite the drive. Due to the resulting eccentric position of the centre of gravity relative to the connecting flange, the milling drum tilts over the connecting flange during handling. There is also the fact that, when replacing the milling drum under practical conditions, the ground is frequently uneven so that replacing the milling drum is made significantly more difficult. The tools positioned on the milling drum create an irregular three-dimensional surface structure of the milling drum, which results in said milling drum assuming a not clearly definable tilted position on a transport device, such as a forklift truck. Once the milling drum with its heavy weight rests on the lifting device, it can no longer be turned on said lifting device. In view of this, mounting a milling drum at the drum gearbox is extremely difficult even with the aid of a lifting device, in which process the projecting stud bolts of the drum gearbox can easily be damaged and must then be replaced with additional mounting effort.

SUMMARY OF THE INVENTION

It is therefore the object of the present invention to simplify the replacement of a milling drum and to facilitate mounting and removal of a new milling drum while simultaneously reducing the repair effort.

The above object is achieved, according to the invention, in that the milling drum drive comprises, as a minimum, one mounting stud which engages with a corresponding opening adapted to said mounting stud in the connecting flange of the milling drum, wherein the mounting stud projects axially vis-à-vis the stud bolts to such an extent that the milling drum rests on the mounting stud prior to engaging with the stud bolts.

The invention advantageously provides that, during the mounting procedure, the milling drum, after having been aligned to the milling drum drive, can first be pushed onto the mounting stud projecting vis-à-vis the stud bolts so that an alignment of the cut-outs, for example, drill holes in the connecting flange, to the stud bolts is initially not of the essence and the milling drum can be supported on the mounting stud. The milling drum can then easily be turned on the mounting stud until the drill holes are in alignment with the stud bolts, in which arrangement the milling drum can then be pushed on further until, in the end, the milling drum has been fully pushed onto the stud bolts and a possible centering spigot of the drum gearbox engages with a complementary central opening in the connecting flange of the milling drum. Thereafter, the milling drum can be permanently fastened using the usual fastening means.

The at least one mounting stud is preferably of replaceable design. This enables the mounting stud to be replaced in the event of the same being damaged, or the mounting of mounting studs of different shape or diameter, and it additionally permits the alternative to not mount the mounting stud if milling drums of an older design are to be mounted that are not compatible with a mounting stud. A further alternative provides for the mounting stud to be used for the purpose of mounting only and removed for the operation of the road milling machine as the mounting stud cannot remain there, for example, due to a lack of installation space.

A single mounting stud is preferably intended coaxially to the milling drum drive and to the milling drum. The central arrangement of a single mounting stud enables particularly simple and safe mounting of the milling drum.

The milling drum is preferably of integral design and comprises a single, axially eccentrically arranged connecting flange. The milling drum is comprised of a drum carrying the tools and of a single connecting flange for connection to the milling drum drive, which results in a cantilevered support of the milling drum. As the milling drum drive protrudes into the milling drum, the connecting flange of the milling drum is arranged eccentrically in axial direction, that is, in the area of the last third of the milling drum.

The stud bolts projecting from the milling drum drive are arranged on a hole circle, with the mounting stud being arranged concentrically to the stud bolts and radially inside relative to the same.

The mounting stud may taper towards the outside. Pushing on the milling drum with its central opening is thus facilitated as a less accurate positioning of the milling drum is sufficient in order to enable pushing the same onto the mounting stud.

The central opening of the connecting flange may alternatively or additionally widen towards the milling drum drive.

A preferred embodiment intends for the outer front end of the milling drum to end nearly flush with the lateral outer side of the machine frame, the so-called zero-clearance side, in order to enable milling as close along any obstacles as possible. In this arrangement, the machine frame is preferably supported by a chassis comprising a front axle and a rear axle with wheels, with the milling drum being arranged between the rear wheels. This arrangement concerns the normal operation of the road milling machine in which both rear wheels are arranged coaxially and preferably in a vertical plane with the milling drum axis. For the close-to-edge operation, a pivoting rear wheel may be provided on the zero-clearance side which can be pivoted into a position in front of the milling drum and inwards relative to the zero-clearance side. Such an arrangement is known, for example, from DE 196 31 042 A1.

The road milling machine is preferably a rear-loading milling machine in which a transport device for the milled material worked off by the milling drum discharging towards the rear is arranged behind the milling drum as seen in the direction of travel.

A cover cap may be attached at the mounting stud. Said cover cap protects the ends of the stud bolts and the fastening means interacting with the stud bolts, such as nuts, and prevents the fastening means from being contaminated or damaged during the milling operation.

The central opening in the connecting flange of the milling drum may comprise an inner supporting surface resting on the mounting stud, said supporting surface not fully enclosing the mounting stud. The multiply interrupted supporting surface facilitates pushing of the milling drum onto the mounting stud and reduces the effects of changes in temperature while a sufficient supporting surface is ensured at the same time.

The mounting stud is preferably arranged coaxially to a centering spigot, in which arrangement the mounting stud may additionally feature, at least on the side facing the centering spigot, essentially the same outer diameter as the centering spigot. It is understood that, in the event of a mounting stud, a centering device may be present but is not mandatory.

The mounting stud may be chamfered at its free end in order to facilitate pushing on of the milling drum.

In a method for mounting a cantilevered milling drum in a road milling machine, in particular small milling machine, for working road surfaces, in which the milling drum is driven by a milling drum drive, where stud bolts for mounting the milling drum project from the milling drum drive, said stud bolts engaging with cut-outs or drill holes arranged accordingly in a connecting flange of the milling drum, the following steps are advantageously intended:

lifting and aligning the milling drum to the milling drum drive, pushing the milling drum onto a mounting stud projecting from the milling drum drive further than the stud bolts in such a fashion that the connecting flange, with its central opening, rests on the mounting stud, turning the milling drum about the mounting stud until the stud bolts of the drum drive are in alignment with the corresponding drill holes in the connecting flange, pushing the milling drum on further until the stud bolts exit from the drill holes of the connecting flange, and fastening the milling drum by means of the stud bolts and corresponding fastening nuts.

In the following, one embodiment of the invention is explained in greater detail with reference to the drawings.

BRIEF DESCRIPTION OF THE DRAWINGS

The following is shown.

DETAILED DESCRIPTION

Figure 1:
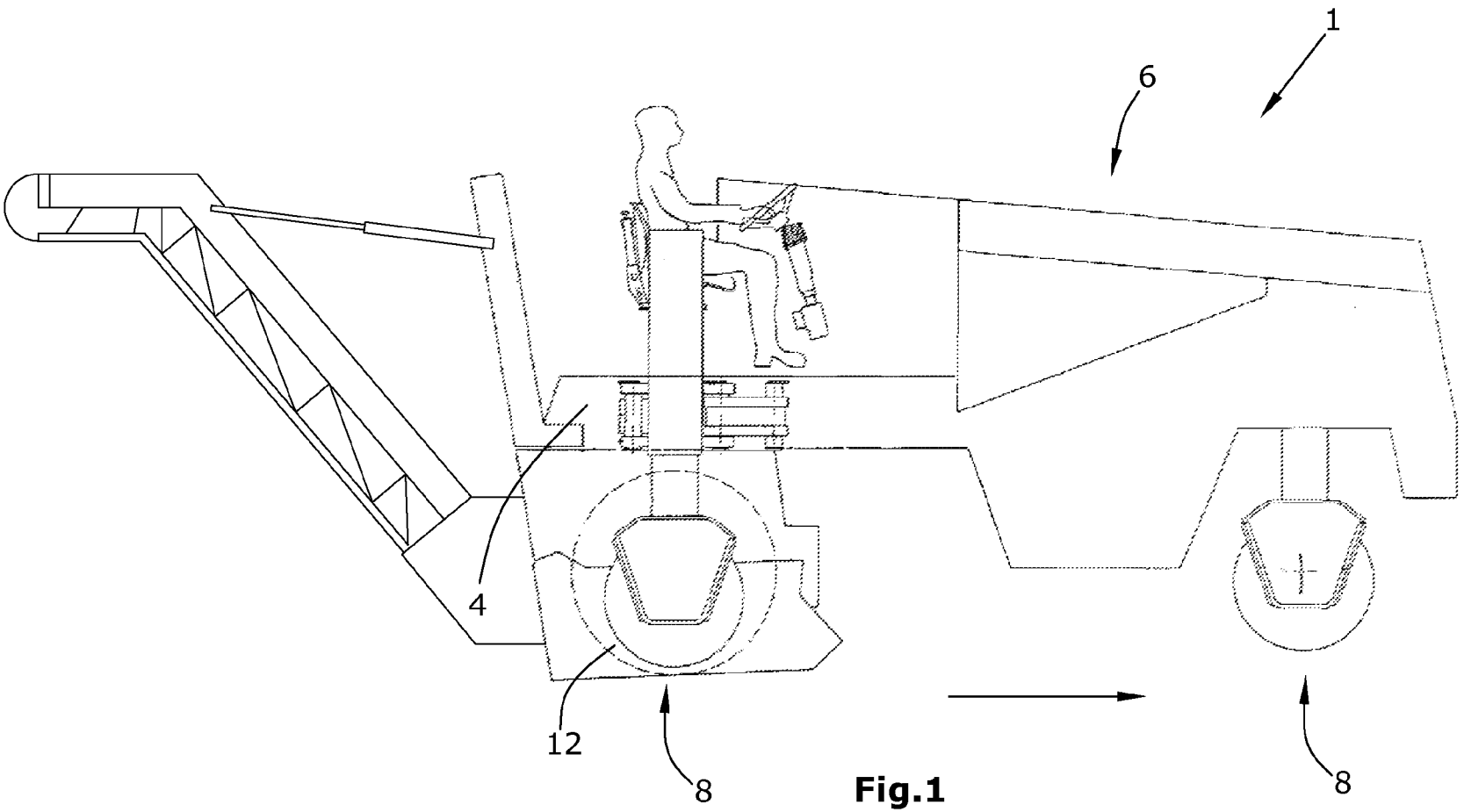
FIG. 1 a small milling machine.

The automotive road milling machine 1 for working ground surfaces depicted in FIG. 1, for example, a small milling machine, comprises a machine frame 4 as well as a drive engine 6 for driving travelling mechanisms 8 and working devices. In the embodiment in FIG. 1, the travelling mechanisms 8 are comprised of wheels but may also be comprised, wholly or in part, of crawler tracks. The main working device is comprised of a milling drum 12 for milling the ground surface that is capable of being driven by a milling drum drive 10.

Figure 2:
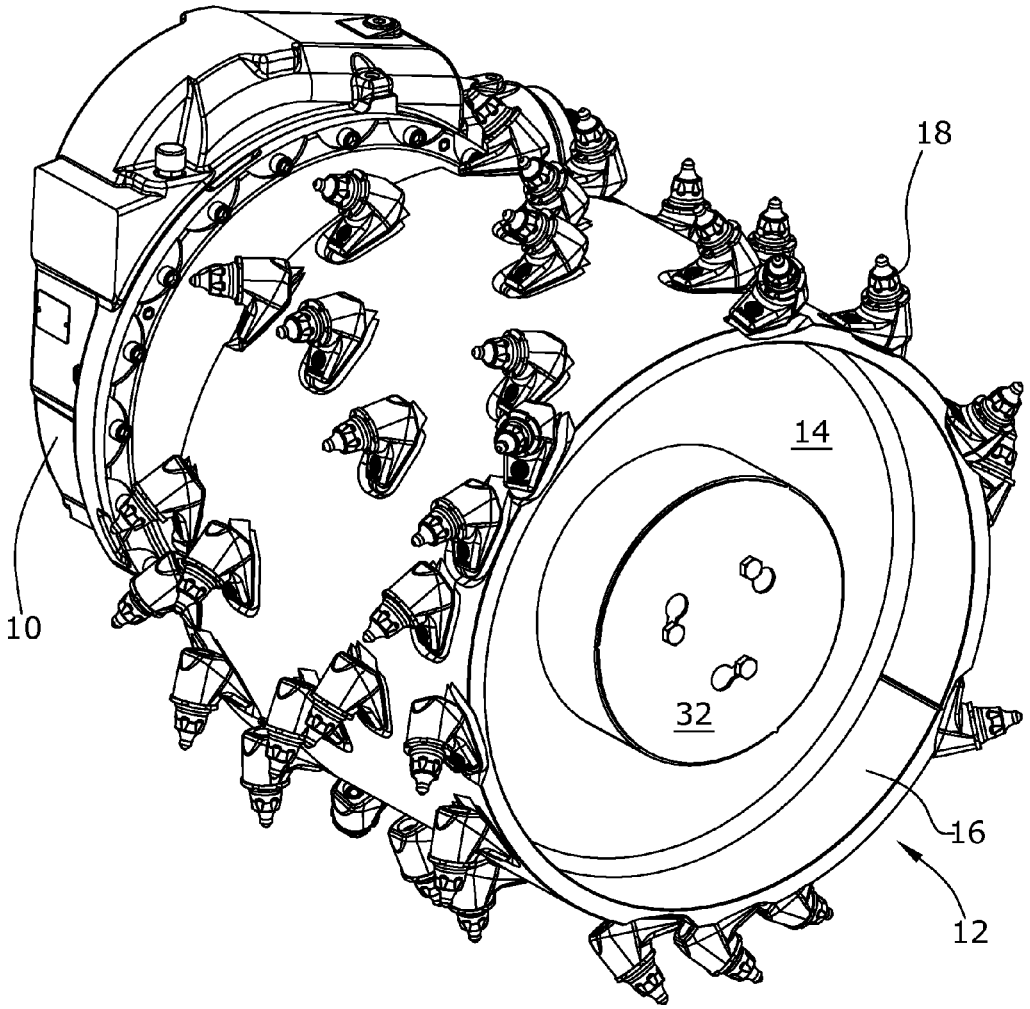
FIG. 2 a perspective view of the milling drum of a road milling machine according to the invention, FIG. 3 a section of a part of the drum gearbox and the milling drum prior to pushing on the milling drum, FIG. 4 the milling drum pushed onto the mounting stud prior to the engagement with the stud bolts, FIG. 5 the milling drum in fastened condition, and [the nuts are missing in the figure but the protective hood has already been mounted!]

FIG. 2 shows a perspective view of the mounted milling drum 12 with a connecting flange 14 and a drum 16 which carries a multitude of systematically arranged tools 18.

Figure 3:
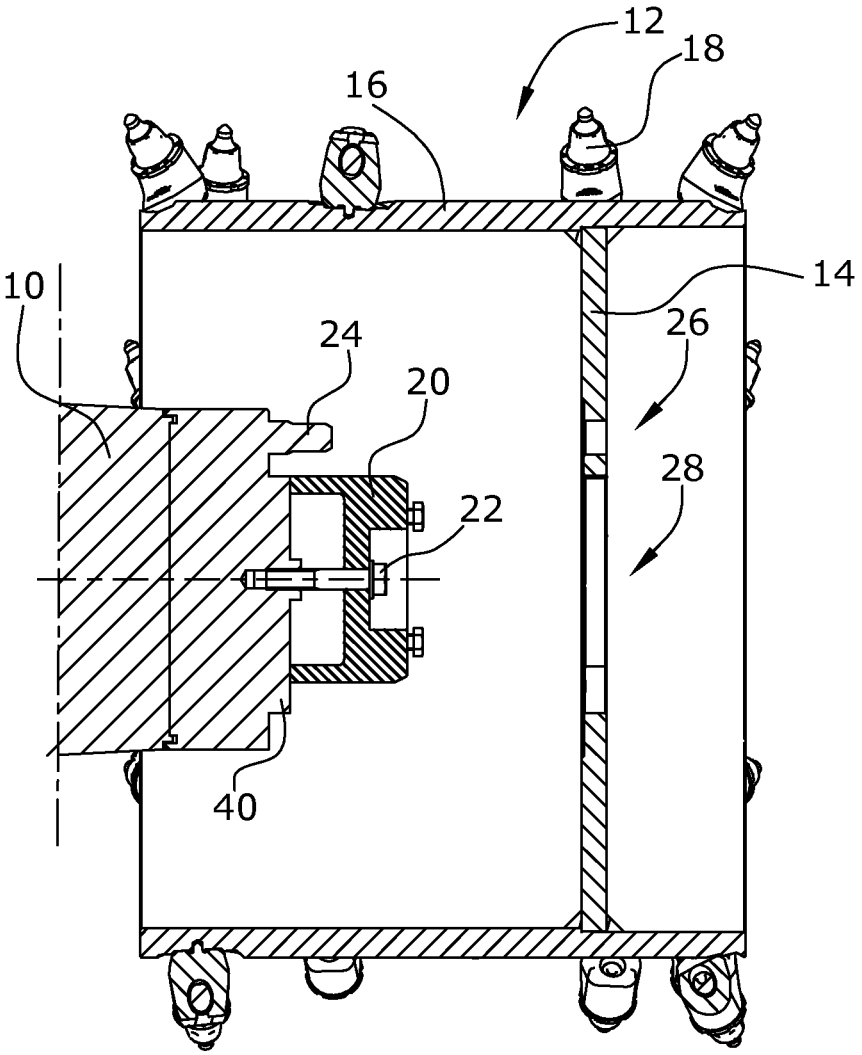

FIG. 3 shows a section through a part of the milling drum drive 10 and through the milling drum 12 prior to mounting. At its free end, the milling drum drive 10 comprises a mounting stud 20 extending coaxially to the not depicted output shaft, where said mounting stud 20 is fastened to the milling drum drive 10 in a replaceable fashion via fastening means 22. Moreover, for example, seven stud bolts 24 arranged on a circular hole pattern project axially from the milling drum drive 10, said stud bolts 24 interacting in corresponding cut-outs 26 in the connecting flange 14 in order to fasten the connecting flange 14, and thus the milling drum 12, at the milling drum drive 10.

Furthermore, the connecting flange 14 features a central opening 28 which is adapted to the diameter of the mounting stud 20. The central opening 28 may be of circular design or may, for example, exhibit the contour inferable from FIG. 6. The mounting stud 20 may taper towards the outside in the direction of its free end to facilitate pushing on of the milling drum 12.

Figure 4:
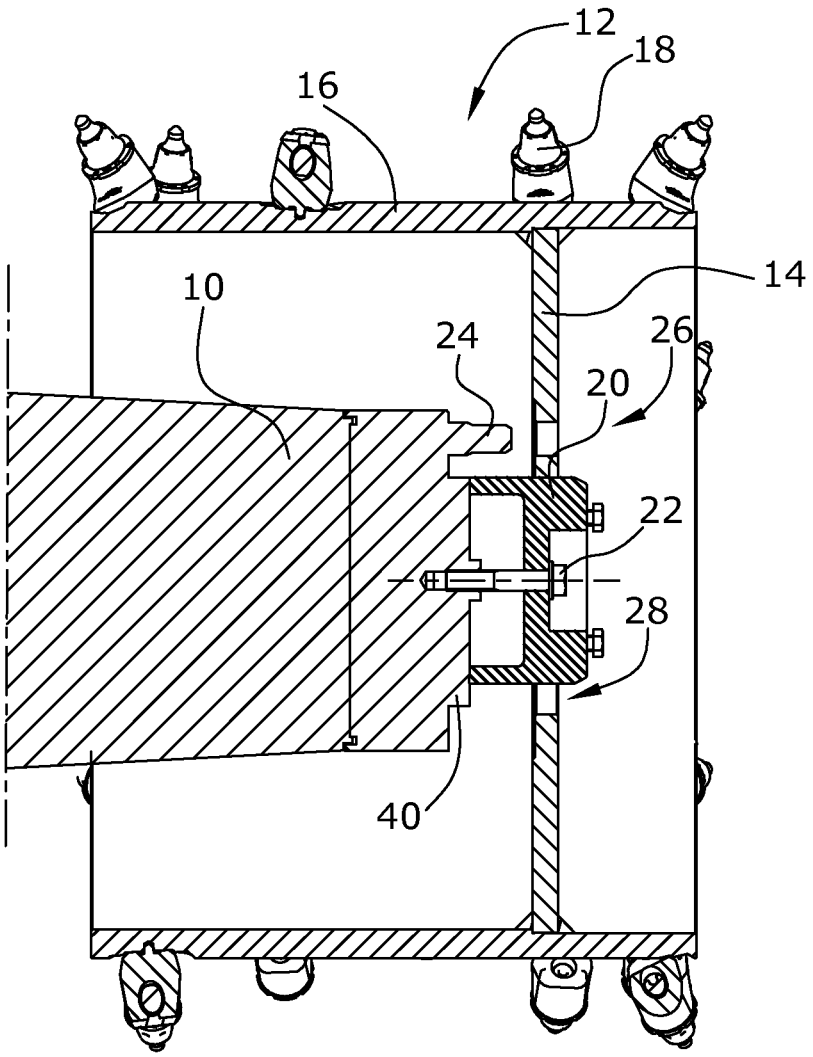

FIG. 4 depicts the milling drum 12 pushed onto the mounting stud 20 in which condition the stud bolts 24 have not yet exited through the cut-outs 26, for example, drill holes.

Figure 5:
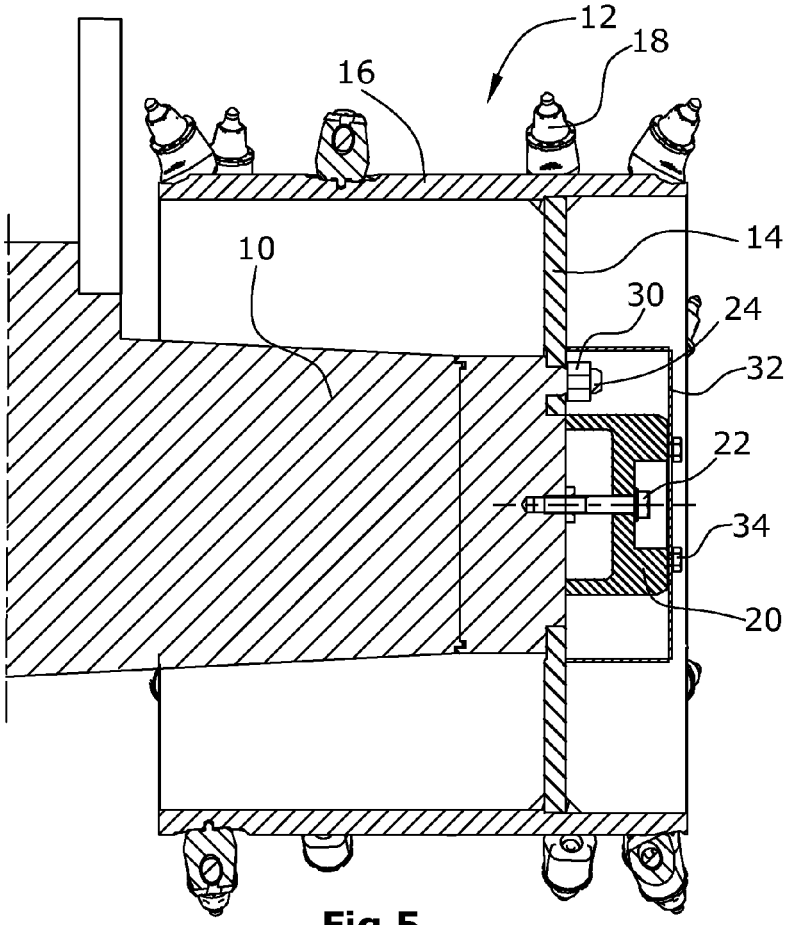

In the position depicted in FIG. 5, the milling drum 12 has been pushed on fully and has been permanently fastened at the milling drum drive 10 via fastening means 30 interacting with the stud bolts 26. In addition, a cover cap 32 may be fastened at the mounting stud 20 via fastening means 34, said cover cap 32 protecting all of the fastening means 24, 26, 28, 30 from contamination and damage.

Figure 6:
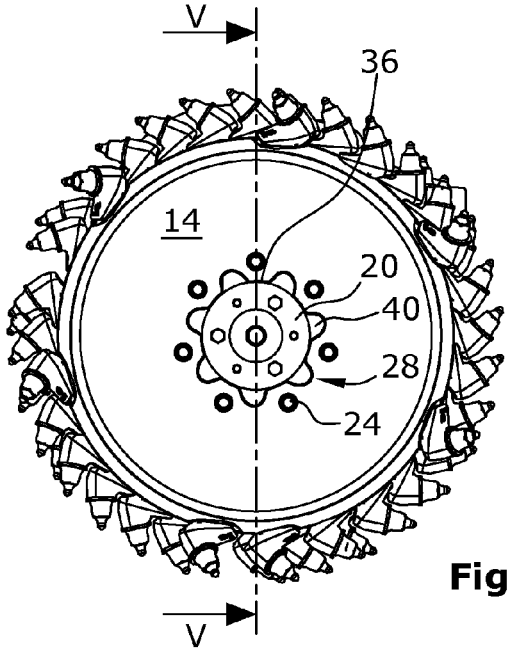
FIG. 6 a front end view of the free end of the milling drum.

As can be inferred from FIG. 6, the central opening 28 may comprise a supporting surface 36 resting on the mounting stud, said supporting surface 36 not fully enclosing the mounting stud 20. The curved contours of the central opening 28 projecting between the supporting surfaces 36 may be adapted to a correspondingly designed centering spigot 40 at the front end of the milling drum drive 10. The purpose of the centering spigot 40 is to reduce the mechanical load of the stud bolts 24 and to precisely centre the milling drum 12 on the milling drum drive 10.

It is understood, however, that the mounting stud 20 can fully assume the function of the centering spigot 40 so that an additional centering spigot 40 is not required.

It is further understood that the mounting stud 20 must not necessarily feature a circular cross-sectional contour but may, for example, also be of a star-shaped or triangular-shaped cross-sectional design.

What is claimed is:

1. A road milling machine, comprising:

a machine frame;

a milling drum supported from the machine frame, the milling drum having an axis of rotation and including a connecting flange, the connecting flange including at least one flange opening and a plurality of bolt holes; and a milling drum drive including at least one axially extending mounting stud sized to be received through the flange opening, and a plurality of axially extending stud bolts, the mounting stud extending axially beyond the stud bolts, so that when mounting the milling drum on the drum drive the flange opening may be received about the mounting stud with the connecting flange of the milling drum resting on the mounting stud prior to axial engagement of the stud bolts with the bolt holes.

2. The road milling machine of claim 1, wherein the mounting stud is configured to be selectively removable from said milling drum drive.

3. The road milling machine of claim 1, wherein the at least one mounting stud is a single mounting stud coaxially aligned with the milling drum drive.

4. The road milling machine of claim 1, wherein the connecting flange is the one and only one connecting flange of the milling drum, and the connecting flange is located axially closer to one end of the milling drum than to another end of the milling drum.

5. The road milling machine of claim 1, wherein the plurality of axially extending stud bolts are arranged in a circular hole pattern, and wherein the mounting stud is positioned concentrically and radially inside the circular hole pattern.

6. The road milling machine of claim 1, wherein the mounting stud tapers toward a free end of the mounting stud.

7. The road milling machine of claim 1, wherein the milling drum includes an outer end nearly flush with a lateral outer side of the machine frame to define the lateral outer side as a zero-clearance side, such that the road milling machine may mill within close proximity to an obstacle.

8. The road milling machine of claim 7, further comprising a chassis supporting the machine frame, including a front axle and a rear axle, the rear axle including wheels or crawler tracks, the milling drum being arranged between the wheels or crawler tracks of the rear axle.

9. The road milling machine of claim 8, wherein a rear axle wheel or crawler track positioned on the zero-clearance side may be selectively pivoted from an outer position to an inner position, the outer position being characterized by the rear wheel or crawler track on the zero-clearance side being essentially coaxial with the rear axle wheel or crawler track of the opposite side, and the inner position being characterized by the rear wheel or crawler track on the zero-clearance side being positioned in front of the milling drum and inwards of zero-clearance side.

10. The road milling machine of claim 1, further comprising a transport device configured to discharge milled material behind the milling drum in a direction opposite of a direction of travel.

11. The road milling machine of claim 1, further comprising a cover cap removably attachable to the mounting stud.

12. The road milling machine of claim 1, wherein said flange opening comprises an inner supporting surface resting on the mounting stud, the inner supporting surface not engaging a complete circumference of the mounting stud.

13. The road milling machine of claim 1, further comprising a centering spigot engaging with the flange opening, the centering spigot being coaxially aligned with the mounting stud.

14. The road milling machine of claim 13, wherein an outer diameter of the mounting stud at its widest point is approximately the same as a smallest outer diameter of the centering spigot.

15. A method of mounting a cantilevered milling drum in a road milling machine, the road milling machine including a machine frame, a milling drum including a connecting flange having a flange opening and a plurality of bolt holes, and a milling drum drive including a mounting stud and a plurality of stud bolts, the mounting stud extending axially beyond the stud bolts, the method comprising the steps of:

(a) lifting the milling drum to the milling drum drive and aligning the milling drum coaxially with the milling drum drive;

(b) pushing the milling drum onto the mounting stud projecting from the milling drum drive such that the flange opening of the milling drum rests on the mounting stud before the flange opening passes the stud bolts;

(c) rotating the milling drum about the mounting stud until the stud bolts are in alignment with the bolt holes of the connecting flange;

(d) pushing the milling drum further onto the mounting stud until the flange opening passes the stud bolts and the stud bolts exit from the bolt holes; and (e) fastening the milling drum to the milling drum drive with the stud bolts and a corresponding plurality of fasteners.

16. The method of claim 15, wherein step (e) further comprises securing a nut to each stud bolt.

17. The method of claim 15, further comprising:

removing the mounting stud from the milling drum drive; and replacing the mounting stud with a new mounting stud.

18. A method of mounting a cantilevered milling drum in a road milling machine, the road milling machine including a machine frame, a milling drum including a connecting flange having a flange opening and a plurality of bolt holes, and a milling drum drive including a mounting stud and a plurality of stud bolts, the method comprising the steps of:

lifting the milling drum to the milling drum drive and aligning the milling drum coaxially with the milling drum drive:

pushing the milling drum onto the mounting stud projecting from the milling drum drive such that the flange opening of the milling drum rests on the mounting stud;

rotating the milling drum about the mounting stud until the stud bolts are in alignment with the bolt holes of the connecting flange;

pushing the milling drum further onto the mounting stud until the stud bolts exit from the bolt holes;

fastening the milling drum to the milling drum drive with the stud bolts and a corresponding plurality of fasteners;

removing the milling drum from the milling drum drive;

removing the mounting stud from the milling drum drive; and attaching a new milling drum without using a mounting stud.

19. The method of claim 15, further comprising:

attaching a cover cap over the mounting stud such that the mounting stud and stud bolts are covered and protected from contamination or damage.

20. The method of claim 15, wherein the road milling machine further includes a chassis supporting the machine frame, the chassis including a front axle and a rear axle, the rear axle including wheels or crawler tracks, the method further comprising:

pivoting a wheel or crawler track of the rear axle from an outer position essentially coaxial with the rear axle wheel or crawler track of the opposite side, to an inner position in front of the milling drum.

* * * * *